United States Patent [19]

Heberlein et al.

[11] 4,250,363

[45] Feb. 10, 1981

[54] ELECTRICAL CIRCUIT BREAKING DEVICE AND METHOD

[75] Inventors: Joachim V. R. Heberlein, Pittsburgh; Francis A. Holmes, Monroeville, both of Pa.

[73] Assignee: Electric Power Research Institute, Inc., Palo Alto, Calif.

[21] Appl. No.: 967,080

[22] Filed: Dec. 6, 1978

[51] Int. Cl.[3] ..... H01H 33/66

[52] U.S. Cl. ..... 200/144 B; 200/146 R

[58] Field of Search ..... 200/144 R, 144 B, 146 R, 200/146 A, 146 AA

[56] References Cited

U.S. PATENT DOCUMENTS

| | | | |
|---|---|---|---|
| 3,017,480 | 1/1962 | Klaassen | 200/146 R |
| 3,211,866 | 10/1965 | Crouch et al. | 200/144 B |
| 3,244,843 | 4/1966 | Ross | 200/144 B |
| 3,283,100 | 11/1966 | Frink | 200/144 B |
| 3,555,223 | 1/1971 | Robinson et al. | 200/146 R X |

FOREIGN PATENT DOCUMENTS

| | | | |
|---|---|---|---|
| 1163272 | 9/1969 | United Kingdom | 200/144 B |

OTHER PUBLICATIONS

Slade, Paul G.; IEEE Transactions on Parts, Hybrids and Packaging; "Contact Materials for Vacuum Interrupters", vol. PHP-10; No. 1; Mar. 1974, pp. 43–47.

*Primary Examiner*—James R. Scott

*Attorney, Agent, or Firm*—Flehr, Hohbach, Test

[57] ABSTRACT

An electrical circuit breaking device adapted for connection in circuit with an electrical conductor for interrupting the current passing through the latter is disclosed herein. This device includes an arrangement of larger and smaller electrode contacting surfaces which are separated from one another in a way which improves the continuous current carrying capability of the device while maintaining satisfactory interruption capability.

10 Claims, 6 Drawing Figures

ELECTRICAL CIRCUIT BREAKING DEVICE AND METHOD

BACKGROUND OF THE INVENTION

The present invention relates generally to electrical circuit breaking devices and more particularly to a vacuum type circuit interrupter with separate current carrying and arcing electrode contact surfaces which are of predetermined configuration and which move relative to one another in a predetermined way for providing improved current carrying capabilities while, at the same time, maintaining reliable interruption capabilities.

Vacuum type circuit interrupters are usually called upon to carry a steady state current of several hundred to several thousand amperes. When a fault occurs, the contact must be rapidly separated to achieve the desired separation as soon as possible. Small electrodes have small mass and can be rapidly separated with reasonable forces. Unfortunately, small electrodes are limited in the steady state current they can carry without overheating. Larger diameter electrodes spread the point of contact (asperities), reduce the power dissipated at the contact interface and provide a further advantage of being able to interrupt larger fault currents. Unfortunately, large electrodes in general have greater mass and require greater forces to achieve the same separation at the same time or stated another way, when applying the same force, the more massive electrodes separate at a slower rate of speed, if at all.

As will be discussed in more detail hereinafter, the present invention combines the advantages of larger current carrying electrodes having a relatively large mass with the advantages of smaller arcing electrodes by providing a particular means for and method of separation between the separate current carrying and arcing contact surfaces. In this regard, reference is made to U.S. Pat. Nos. 3,211,866 (Crouch et al) and 3,283,100 (Frink). Each of these patents discloses a vacuum type circuit interrupter which includes current carrying contacts and separate arcing contacts. In each of these disclosures, one fixed electrode defining a fixed contact surface is provided on one side of the interrupter and two electrically connected movable electrodes, each having its own contact surface, are provided on the opposite side of the interrupter. During normal operation, the interrupter described in each of these patents passes current by maintaining each of its movable electrodes in either direct contact with the fixed electrode or indirectly in contact therewith. For example, in the Crouch et al patent, both of the movable electrodes are in direct contact with the fixed electrode, whereas in the Frink patent one of the movable electrodes is in direct contact with the fixed electrode while the other movable electrode is indirectly connected therewith by means of a slotted metallic cylinder and condensing shield. However, in each case, the circuit is opened by first separating one of the movable electrodes from the fixed electrode before separating the other movable electrode from the fixed electrode. From an operation standpoint, only the contact surfaces which are subsequently separated act as arcing contacts.

While each of the references just described discloses a vacuum type circuit interrupter including separate non-arcing and arcing contact surfaces, neither recognizes or remotely suggests combining the advantages of a large contact surface with a small contact surface for improving the current carrying capability of its interrupter while at the same time providing satisfactory current interruption. Moreover, neither of these interrupters by the very nature of their design is capable of taking advantage of such a combination. More specifically, in each of these prior art interrupters, the movement of each of the two movable contact surfaces is interlocked with the other such that predetermined movement of the first movable contact surface causes subsequent movement of the second movable contact surface. Moreover, the two surfaces move at the same speed and by means of a common application of force.

Applicants have found that to provide satisfactory separation of the larger current carrying contact surfaces and the smaller arcing contact surfaces, the electrodes should be moved by separate independent means. This provides three distinct advantages over the interlocked movement described in the Crouch et al and Frink patents. First, the smaller electrode can be more readily moved at a faster rate of speed than the larger electrode for quicker separation. Second, the application of force required to move the smaller electrode by independent means does not have to be the same as the force required to move the larger electrode and, hence, can be smaller in magnitude. Third, the timing between movement of the larger electrode and the smaller electrode can be easily adjusted and even changed significantly if necessary using independent moving means whereas it would not be as easy to do this with the interlocked means disclosed in the cited patents.

Objects and Summary of the Invention

One object of the present invention is to provide an electric circuit breaking device, specifically a vacuum type circuit interrupter in a preferred embodiment, having current carrying electrodes and separate arcing electrodes.

Another object of the present invention is to provide a circuit breaking device which incorporates the advantages of large electrodes, for providing high current carrying capabilities with the advantages of small electrodes, for providing reliable current interruption.

Still another object of the present invention is to independently separate the larger and smaller electrodes in a circuit breaking device of the type just recited.

Yet another object of the present invention is to separate the smaller electrodes at a faster rate of speed than the larger electrodes and/or with less force.

Still another object of the present invention is to provide a circuit breaking device of the type described but particularly one which can be easily modified to adjust change or change significantly the timing of separation between the larger current carrying electrodes and the smaller arcing electrodes.

A further object of the present invention is to provide a method of interrupting the current passing through an electrical conductor using a circuit breaking device of the type recited above.

As will be discussed in more detail hereinafter, the electrical circuit breaking device disclosed herein and constructed in accordance with the present invention includes two separate electrode arrangements having current carrying contact surfaces as well as arcing surfaces. This device also includes (1) first means for separating the current carrying contact surfaces a predetermined distance from one another, (2) means for maintaining the arcing contact surfaces in their current passing position during the separating movement of the current carrying surfaces and, in accordance with the present invention, (3) moving means independent of the first moving means for separating the arcing contact surfaces a predetermined distance from one another after separation of the current carrying surfaces. In this way, the arcing surfaces which are preferably smaller than the larger current carrying surfaces, can be readily moved at a higher rate of speed and with less force. Moreover, by providing independent means for separating the two types of surfaces, the timing between separation of the different surfaces can be easily adjusted in order to "fine tune" the device or even changed significantly.

DETAILED DESCRIPTION AND PREFERRED EMBODIMENTS

Figure 1:
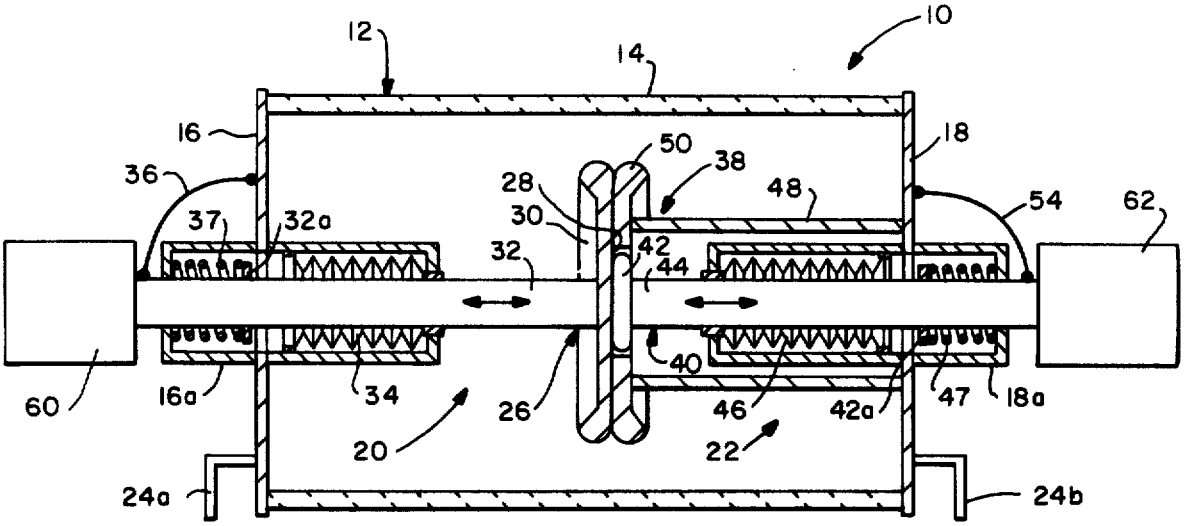
FIG. 1 is a longitudinal sectional view of a vacuum type circuit interrupter which is constructed in accordance with the present invention and which is specifically shown in an operationally closed position for passing current therethrough.

Turning now to the drawings, attention is specifically directed to FIG. 1 which, as stated, illustrates a vacuum type electric circuit interrupter constructed in accordance with the present invention. This interrupter is generally designated by the reference numeral 10 and includes an overall evacuated housing 12. The housing is comprised of a longitudinally extending, cylindrical body 14 constructed of a suitable insulating material such as ceramic and two electrically conductive end plates 16 and 18 seal connected along their outer peripheries to insulating body 14. This overall housing, which in and by itself may be conventional and readily provided, is evacuated to a predetemined pressure, for example to a pressure of $10^{-4}$ mm. of mercury or even lower. Moreover, while not shown it includes a conventional arc shield located concentrically inward of body 14 for protecting the latter.

Interrupter 10 also includes two electrode arrangements, an arrangement 20 which is located on one side of housing 12 and an arrangement 22 located on the other side of the housing. As will be seen below, these two arrangements are provided for passing current through the housing when the interrupter is connected in line with an electrical conducter and for interrupting the current passing through the latter. In this regard, each end plate 16 and 18 may respectively include a flanged connector 24*a* and 24*b* or the like for electrically connecting the interrupter in line with the conductor.

Figure 2A:
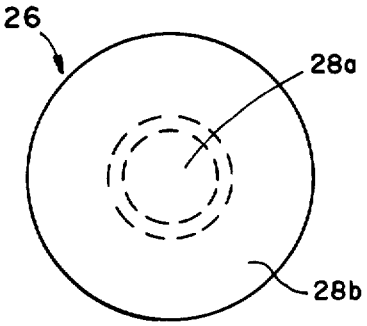
FIG. 2*a, b* and *c* illustrate the front faces of three electrodes comprising part of the interrupter of FIG. 1.

As illustrated in FIG. 1, electrode arrangement 20 includes a single electrode 26 having a single continuous electrode contact surface which, as best seen in FIG. 2*a*, is circular in configuration. For reasons to become apparent hereinafter, this single continuous surface may be subdivided into two separate surfaces, an inner circular surface 28*a* and an outer circumferential surface 28*b* which circumscribes surface 28*a* and which is significantly larger in surface area than the latter. In an embodiment, surface 28*a* is about 3.1 square inches in area whereas surface 28*b* is 23 square inches. Obviously, these two surfaces are electrically interconnected to one another by virtue of the fact that they comprise parts of the single overall surface which is part of an enlarged section 30 of electrode 26. This electrode also includes a longitudinally extending shaft 32 located partially within housing 12 and partially outside the housing through end plate 16. Shaft 32 and enlarged section 30 are supported by a flexible metallic bellows assembly 34 for longitudinal movement between an extended or forward position illustrated in FIG. 1 and a retracted position illustrated in FIGS. 3 and 4. This metallic bellows assembly which comprises part of arrangement 20 not only supports electrode 26 for longitudinal movement but also provides a seal between the electrode and housing. In this regard, in order to provide electrical connection between electrode 26 and flange 24*a*, a flexible conducter 36 is connected between the shaft and plate 16. Electrode 26 is biased in its extended position by any suitable means. For example, as illustrated in FIG. 1, this is accomplished by means of a spring 37 located between a lug 32*a* on shaft 32 and an annular housing 16*a* on end plate 16.

Figure 2B:
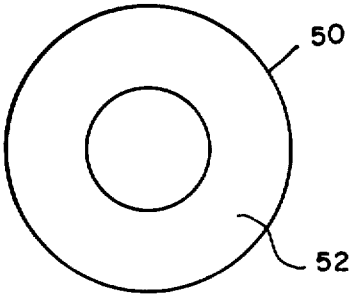
Figure 2C:
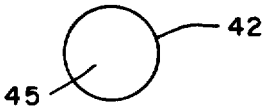

Having described arrangement 20, attention is now directed to electrode arrangement 22. This latter arrangement includes two electrodes, an outer electrode 38 fixed within housing 12 and a moveable inner electrode 40. As illustrated in FIG. 1, the movable electrode 40 includes an enlarged section 42 located at one end of a longitudinal shaft 44 which is located partially within housing 12 and partially outside the housing through end plate 18. As seen best in FIG. 2*b*, enlarged section 42 includes an electrode contact surface 45 which is identical in configuration to previously described contact surface 28*a* and which, as will be seen, is provided for physically contacting the latter. Arrangement 22 also includes a flexible metallic bellows assembly 46 supporting shaft 44 and enlarged section 42 for movement between a retracted position illustrated in FIGS. 1 and 4 and an extended (forward) position illustrated in FIG. 3. This bellows assembly, like the previously described bellows assembly, also provides a seal between its shaft 44 and housing 12. Moreover, electrode 40 is also biased in its extended position by suitable means such as spring 47 located between a lug 42*a* on shaft 42 and another housing 18*a* on end plate 18.

As stated above, outer electrode 38 is fixed within housing 12. This electrode also includes a longitudinally extending shaft, specifically a hollow shaft 48 which, in a preferred embodiment, has a relatively thick wall (in cross section), and is constructed of a relatively efficient thermal conductor, preferably copper. As seen in FIG. 1, the hollow shaft is coaxial with and circumscribes previously described shaft 42 of electrode 40. Electrode 38 also includes an enlarged section 50 which circumscribes enlarged section 42 of electrode 40 when the latter is in its retracted position. Enlarged section 50 includes an electrode contact surface 52 which is identical in configuration to previously described surface 28*b* and hence is significantly larger in surface area than surface 45. Electrode 38 is supported in a fixed position within housing 12 by suitable means, for example by means of end plate 18. In this regard, as seen in FIG. 1, shaft 48 and end plate 18 are in physical contact with one another for providing an electrical connection therebetween and the end plate is placed in electrical connection with movable shaft 44 by means of a flexible conductor 54, thereby placing the two electrodes 36 and 38 in electrical contact with each other.

Having described electrode arrangements 20 and 22, attention is now directed to the way in which the individual electrodes are positioned, first to pass current through the interrupter and thereafter to interrupt passage of the current therethrough. In FIG. 1, movable electrode 26 of arrangement 20 is shown in its extended position while maintaining movable electrode 36 in its retractable position by overcoming the biasing force of spring 47. As a result, surface 28*a* of electrode 26 engages against surface 45 of electrode 36 while, at the same time, larger surface 28*b* of electrode 26 engages against the larger surface 52 of electrode 38. As a result, current passes through housing 12 from electrode 26 to the parallel connected electrodes 38 and 40. In this regard, since the outer contact surfaces are significantly larger than the inner contact surfaces, the overall contact surface between electrode arrangement 20 and arrangement 22 is more than doubled compared to the contact surface defined by surfaces 28*a* and 45 alone. This spreads the points of contact substantially and reduces the power dissipated at the contact interface. However, as will be seen, this is accomplished without compromising the interrupting capability of the smaller electrodes.

Figure 3:
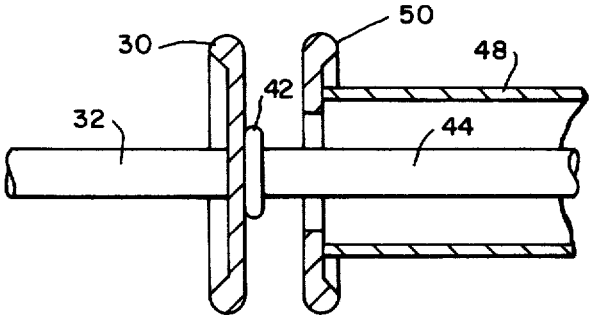
FIG. 3 schematically illustrates the electrodes comprising part of the circuit interrupter of FIG. 1 in a partially opened (separated) position.

In order for interrupter 10 to electrically open, electrode 26 is initially moved from its extended position illustrated in FIG. 1 to its retracted position illustrated in FIG. 3 overcoming the biasing force of spring 37. At the same time, moveable electrode 40 of arrangement 22 is biased in its extended position, as stated previously, and hence automatically moves from its retracted position forward to its extended position as electrode 26 moves to its retracted position. In this way, the two surfaces 28*a* and 45 remain continuously in contact with one another while the surfaces 28*b* and 52 separate from one another a predetermined distance, as seen in FIG. 3. With the electrodes positioned in this way, it should be apparent that current continues to pass between the two electrode arrangements, specifically between surfaces 28*a* and 45. Accordingly, during separation of the larger surfaces 28*b* and 52, arcing does not take place and hence these two surfaces do not have to be separated rapidly and therefore even though each of the electrodes 26 and 38 may be relatively massive, it is not necessary to utilize relatively high forces to separate them.

Figure 4:
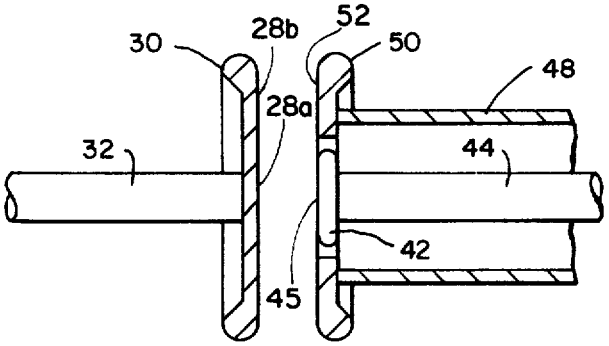
FIG. 4 schematically illustrates the electrodes in a completely opened (separated) position for operationally interrupting the current which otherwise passes therethrough.

After the two larger contact surfaces have been separated in the manner described, electrode 40 is moved from its extended position illustrated in FIG. 3, to its retracted position illustrated in FIG. 4 (overcoming the biasing force of spring 47) for separating the two surfaces 28*a* and 45 a predetermined distance from one another, thereby interrupting the current between the two electrode arrangements. Obviously, arcing does take place between these two contact surfaces as they are separated. However, since surfaces 28*a* and 45 are relatively small in surface area compared to surfaces 28*b* and 52, electrode 40 does not have to be as massive as the other two electrodes and hence can be more rapidly moved from its extended position to its retracted position with less force.

From the foregoing, it should be apparent that overall circuit interrupter 10 must include means for moving electrode 26 from its extended position to its retracted position for separating surfaces 28*b* and 52 and means for moving electrode 40 from its extended position to its retracted position for separating surfaces 28*a* and 45 after separation of surfaces 28*b* and 52. In accordance with the present invention, these means are separate and distinct from one another. More specifically, as illustrated in FIG. 1, interrupter 10 includes an assembly generally designated at 60 for moving electrode 26 from its extended position to its retracted position. This assembly may be of any conventional type such as electromechanical solenoid device, or it may be strictly mechanical in nature. Moreover, while biasing spring 37 provided for moving electrode 26 back to its extended position is shown comprising part of electrode arrangement 26, it can be readily incorporated into assembly 60. A second assembly 62 which may be similar to assembly 60 is provided for moving electrode 40 from its extended position to its retracted position. Assembly 62, like assembly 60, may be a conventional electromechanical solenoid device or it may be completely mechanical. Moreover, it may include previously described biasing spring 47 or, as illustrated, the biasing spring may comprise part of arrangement 22 as described above. In any event, because electrode 40 is less massive than electrode 26 in a preferred embodiment, assembly 62 can more easily and/or more rapidly move its electrode than assembly 60. In addition because the two assemblies are distinct from one another, the actuation time of each can be readily changed. In this regard, the overall interrupter would of course include suitable means for actuating assemblies 60 and 62 in the event the current through the conductor were to reach a predetermined upper value or if it were merely desirable to shut down the line.

While electrode arrangements 20 and 22 along with independent moving assemblies 60 and 62 have been described as part of an overall vacuum type circuit interrupter, it is to be understood that these arrangements and assemblies could be provided as part of an electrical circuit breaking type device generally. Moreover, while electrode 26 and electrode 40 are moved in the manner described in a preferred embodiment, it is to be further understood that the present invention is not limited to the particular movement described. For example, it is possible to design the two electrode arrangements so that the two electrodes 40 and 38 are the moving electrodes, providing that separation between all the electrodes is consistent with the present invention.

Moreover, it is to be understood that the previously described electrodes 26, 38 and 40 and particularly their enlarged sections 30, 42 and 50, respectively, may be constructed of any material suitable for the intended function of each electrode. The material may be identical for each electrode and enlarged section or it may differ from one enlarged section to the other, especially sections 42 and 50, because of the different functions of each. Those with skill in the art based on the teachings herein and a certain publication to be recited can readily determine the material to be used. This publication is one by Paul G. Slade entitled CONTACT MATERIALS FOR VACUUM INTERRUPTERS published in IEEE Transactions on Parts, Hybrids, and Packaging, Vol. PHP-10, No. 1, March 1974.

What is claimed is:

1. An electrical circuit breaking device adapted for connection in circuit with an electrical conductor for interrupting the current passing through the latter, said device comprising:

(a) a first electrode arrangement including a single electrode having an inner contact surface and a larger outer contact surface surrounding the inner surface and means supporting said electrode for movement between an extended position and a retracted position;

(b) first means for moving said first electrode between its extended and retracted positions;

(c) a second electrode arrangement including (i) a second electrode havng a contact surface corresponding in surface area to the surface area of said inner contact surface, (ii) means for supporting said second electrode for movement between a biased extended position such that its contact surface is in physical contact with said inner surface of said single electrode regardless of the position of said single electrode and a retracted position out of contact with said inner contact surface when said single electrode is in its retracted position, (iii) a third electrode having a circumferential contact surface which is spaced outwardly from and which circumscribes said second electrode contact surface, said third electrode contact surface corresponding in surface area to the surface area of said outer contact surface of said single electrode, (iv) means for supporting said third electrode in a fixed position such that its contact surface is in physical contact with said outer contact surface of said single electrode when the latter is in its extended position and such that its contact surface is out of physical contact with said outer contact surface when said single electrode is in its retracted position, and (v) means for electrically connecting said second and third electrodes together regardless of the position of said second electrode; and (d) second means independent of said first moving means for moving said second electrode between its biased extended position and its retracted position, said second means moving said second electrode to its retracted position from its extended position after movement of said single electrode from its extended position to its retracted position.

2. A device according to claim 1 wherein said second moving means moves said second electrode at a faster rate of speed than the movement of said single electrode by said first moving means.

3. A device according to claim 1 wherein said second moving means moves said second electrode with less force than the force exerted by said first moving means in moving said single electrode.

4. A device according to claim 1 wherein said third electrode is cylindrical in configuration and said second electrode is concentrically located within said first electrode.

5. A device according to claim 4 wherein said third electrode of said second electrode arrangement includes a concentric shaft positioned around said second electrode, said shaft being constructed of an electrically conductive and heat conductive material whereby to conduct heat away from said first contact surfaces.

6. A device according to claim 5 wherein said material is copper.

7. A device according to claim 1 wherein said inner and outer contact surfaces of said single electrode comprise part of a single overall surface on said single electrode.

8. A method of interrupting the current passing through an electrical conductor, said method comprising:

(a) connecting an electrical circuit breaking device in circuit with said electrical conductor, said device including (i) a first electrode arrangement including a single electrode having first and second contact surfaces, (ii) a second electrode arrangement including second and third electrodes respectively having third and fourth contact surfaces and means electrically connecting said third and fourth surfaces together, said third and fourth surfaces being respectively positioned against the first and second contact surfaces of said single electrode when said device is in a closed state for passing said current between said single electrode and said second and third electrodes;

(b) moving said single electrode away from said third electrode for separating said second and fourth contact surfaces from one another a predetermined distance while moving said second electrode toward said single electrode for maintaining said first and third surfaces in said current passing position; and (c) after said second and fourth contact surfaces have been separated from one another said predetermined distance, moving said second electrode away from said single electrode for separating said first and third surfaces a predetermined distance from one another.

9. A method according to claim 8 wherein said first and second surfaces are portions of a single surface and wherein said third surface is smaller in surface area than said fourth surface.

10. A method according to claim 9 wherein said first and third surfaces are separated from one another at a faster speed than separation of said second and fourth surfaces.

* * * * *